US010472751B2

(12) United States Patent
Traser et al.

(10) Patent No.: US 10,472,751 B2
(45) Date of Patent: Nov. 12, 2019

(54) THERMOFUSIBLE SHEET MATERIAL

(71) Applicant: Carl Freudenberg KG, Weinheim (DE)

(72) Inventors: Steffen Traser, Darmstadt (DE); Steffen Kremser, Heddesheim (DE)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 15/558,568

(22) PCT Filed: Apr. 4, 2016

(86) PCT No.: PCT/EP2016/057314
§ 371 (c)(1),
(2) Date: Sep. 15, 2017

(87) PCT Pub. No.: WO2016/169752
PCT Pub. Date: Oct. 27, 2016

(65) Prior Publication Data

US 2018/0057983 A1 Mar. 1, 2018

(30) Foreign Application Priority Data

Apr. 22, 2015 (DE) ..... 10 2015 005 089

(51) Int. Cl.
*D04H 1/68* (2012.01)
*A41D 27/06* (2006.01)
(Continued)

(52) U.S. Cl.
CPC ..... *D04H 1/68* (2013.01); *A41D 27/06* (2013.01); *D04H 1/488* (2013.01); *D04H 1/49* (2013.01);
(Continued)

(58) Field of Classification Search
None
See application file for complete search history.

(56) References Cited

U.S. PATENT DOCUMENTS 4,696,849 A 9/1987 Mobley et al.
5,290,594 A 3/1994 Groshens et al.
(Continued)

FOREIGN PATENT DOCUMENTS

CN 86106969 A 9/1987
DE 10260815 A1 7/2014
(Continued)

OTHER PUBLICATIONS

Wikipedia, "Schlagschaum (Beschichtungsmittel)", Dec. 18, 2015, pp. 1-2.
(Continued)

*Primary Examiner* — Chinessa T. Golden
(74) *Attorney, Agent, or Firm* — Leydig, Voit & Mayer, Ltd.

(57) ABSTRACT

A thermofusible sheet material which can be used as a fusible interlining in the textile industry, has a carrier layer made from a textile material to which a polyurethane foam coating is applied. The polyurethane foam has a pore structure in which more than 50% of the pores have a diameter, measured according to DIN ASTM E 1294, which is in the range of 5 to 30 μm.

22 Claims, 5 Drawing Sheets

(51) Int. Cl.

| | |
|---|---|
| ***D04H 1/488*** | (2012.01) |
| ***D04H 1/49*** | (2012.01) |
| ***D04H 1/66*** | (2012.01) |
| ***D06M 17/10*** | (2006.01) |
| ***D06N 3/18*** | (2006.01) |
| ***D06N 3/00*** | (2006.01) |
| ***D06N 3/14*** | (2006.01) |
| *A41D 31/00* | (2019.01) |

(52) U.S. Cl.

CPC ..... *D04H 1/66* (2013.01); *D06M 17/10* (2013.01); *D06N 3/0043* (2013.01); *D06N 3/146* (2013.01); *D06N 3/183* (2013.01); *A41D 31/00* (2013.01); *D06N 3/005* (2013.01); *D06N 3/0047* (2013.01); *D06N 3/0068* (2013.01); *D06N 2209/123* (2013.01); *D06N 2211/10* (2013.01)

(56) References Cited

U.S. PATENT DOCUMENTS

2002/0065330 A1 5/2002 Klotzer
2002/0155255 A1* 10/2002 Oguri ..... B32B 7/12 428/192
2003/0084788 A1 5/2003 Fraser, Jr.
2005/0014858 A1* 1/2005 Choi ..... C08G 18/12 521/155
2005/0025954 A1* 2/2005 Sullivan, Jr. ..... B29C 45/14811 428/304.4
2006/0127663 A1 6/2006 Strey et al.
2007/0197675 A1* 8/2007 Matsumoto ..... A47C 27/14 521/174
2009/0306239 A1* 12/2009 Mijolovic ..... C08G 18/44 521/172
2011/0104457 A1 5/2011 Kim
2012/0276339 A1* 11/2012 Pearce ..... B29D 99/0092 428/160
2013/0210301 A1* 8/2013 Hirao ..... B32B 27/36 442/59
2014/0079940 A1* 3/2014 Liyanage ..... B29C 44/1261 428/304.4
2015/0133014 A1 5/2015 Traser et al.

FOREIGN PATENT DOCUMENTS

DE 102013021148 A1 4/2015
EP 0547261 A1 6/1993
EP 2846653 A1 3/2015
GB 1162147 A * 8/1969 ..... B29C 44/461
GB 1162147 A 8/1969
JP 03040803 A 2/1991
JP 05295666 A 11/1993
RU 2203127 C2 4/2003
WO WO 0039178 A1 7/2000

OTHER PUBLICATIONS

Wang, Duoren, "Production and Application Guideline of Modern Polymer Material", 1st edition, China Petrochemical Press, p. 307, May 31, 2002.
Chinese Office Action, dated May 8, 2019, pp. 1-13.

* cited by examiner

THERMOFUSIBLE SHEET MATERIAL

CROSS-REFERENCE TO RELATED APPLICATIONS

This application is a U.S. national stage application under 35 U.S.C. § 371 of International Application No. PCT/EP2016/057314, filed on Apr. 4, 2016, and claims benefit to German Patent Application No. DE 10 2015 005 089.3, filed on Apr. 22, 2015. The International Application was published in German on Oct. 27, 2016, as WO 2016/169752 A1 under PCT Article 21(2).

FIELD

The invention relates to thermally fusible fabrics, which can be used in particular as fusible interlinings or linings in the textile industry and are characterized by improved application features and by improved processability, and to the production and use thereof as interlinings for textiles.

BACKGROUND

Interlinings are the hidden framework of an item of clothing. They ensure correct fitting and optimum wear comfort. Depending on their use, they aid the processability of the item of clothing, increase its functionality and stabilize it. The use of these functions can be applied not only to items of clothing, but also to technical textile applications such as in the furniture industry, the upholstery industry and the home textiles industry.

Important features of interlinings are softness, resilience, texture, wash and care resistance and sufficient abrasion resistance of the carrier material when in use.

Interlinings can be made of non-woven fabrics, woven fabrics, knitted fabrics or comparable textile fabrics, most of which are also provided with a glue, meaning that the interlining can usually be bonded to a cover material either thermally by means of heat and/or by pressure (fusible interlining). The interlining is therefore laminated on top of a cover material. The aforementioned variety of textile fabrics have different feature profiles depending on the production method thereof. Woven fabrics consist of threads/yarns in the warp and weft direction, knitted fabrics consist of threads/yarns that are connected by means of a stitch weave to form a textile fabric. Non-woven fabrics consist of individual fibers that are plaited so as to form a fibrous web, which are mechanically, chemically or thermally bonded.

In mechanically bonded non-woven fabrics, the fibrous web is strengthened by mechanically intertwining the fibers, either by means of a needle technique or by intertwining by means of water or steam jets. Although needling provides soft products, they have a relatively fragile texture, and therefore this technology could only be used in very specific niches in the field of interlinings. In addition, when mechanically needling the fabric, a weight per unit area of >50 g/m$^2$ is usually advised, which is too heavy for a number of interlining applications.

Non-woven fabrics strengthened by water jets can have a lower weight per unit area, but are generally flat and not very resilient.

In chemically bonded non-woven fabrics, the fibrous web is provided with a binder (e.g. acrylate binder) by means of impregnation, spraying or by any other conventional application methods, and is then condensed. The binder binds the fibers to one another to form a non-woven fabric, but produces a relatively rigid product as a result, since the binder extends so as to be distributed over large parts of the fibrous web and the fibers are continuously bonded to one another, as in a composite material. Variations in the texture or softness can only be compensated for to a limited extent by fiber blends or by the binder selection.

Thermally bonded non-woven fabrics are usually strengthened by a calender or by hot air for use as interlinings. In non-woven interlining fabrics, punctiform calender strengthening has become accepted nowadays as the standard technology. In this case, the fibrous web generally consists of polyester or polyamide fibers specifically developed for this process and is strengthened by means of a calender at temperatures that approximate to the melting point of the fibers, a roll of the calender being provided with dotted engraving. Such dotted engraving consists of 64 dots/cm$^2$, for example, and can have a welding surface of 12%, for example. Without a dot arrangement, the interlining would be strengthened in a planar manner and would have an unsuitably hard texture.

The various methods described above for producing textile fabrics are known and described in technical books and in the patent literature.

The glues that are usually applied to interlinings are often thermally activatable and generally consist of thermoplastic polymers. According to the prior art, the technology for applying these glue coatings to the fibrous fabric is carried out in a separate working step. Powder-dot, paste-printing, double-dot, scatter and hot-melt methods are usually used as glue technology and are described in the patent literature. These days, double-dot coating is considered to be the most efficient with regard to adhering to the cover material even after care treatment and in terms of re-adhesion.

Such a double dot has a two-layered structure. It consists of a bottom and a top dot. The bottom dot penetrates the base material and serves as a barrier layer to prevent the return flow of glue and to anchor the top dot particle. Conventional bottom dots consist, for example, of binder and/or of a thermoplastic polymer, which contributes to the bonding strength during fusing. Depending on the chemical used, in addition to anchoring the top dot in the base material, the bottom dot also acts as a barrier layer for preventing the return flow of glue. The main adhesive component in the two-layered composite is primarily the top dot. This can consist of a thermoplastic material, which is scattered over the bottom dot in the form of a powder. After the scattering process, the excess powder (between the dots of the bottom layer) has to be sucked away again. After the sintering process that follows, the top dot is (thermally) bonded to the bottom dot and can serve as the adhesive to the top dot.

Depending on the intended use of the interlining, a different number of dots are imprinted and/or the amount of glue or the geometry of the pattern of dots varies. A typical number of dots is, for example, cP 110 at a coating of 9 g/m$^2$ or cP 52 at a coating amount of 11 g/m$^2$.

Paste printing is also widely used. In this technology, an aqueous dispersion consisting of thermoplastic polymers, usually in particle form having a particle size of <80 μm, thickeners and solvent aids is produced, and then imprinted onto the substrate by means of rotary screen printing in the form of a paste and in a mostly punctiform manner. The imprinted substrate then has to be subjected to a drying process.

It is know that a wide variety of hot-melt adhesive can be used as the bonding media for heat bonding interlinings or linings.

There is currently a trend to use thin, transparent, flexible or open cover materials in the clothing industry, particularly for women's clothing. In order to support these cover materials, an interlining that is very lightweight and has an open structure is advantageous.

The problem of coating such materials using common aqueous paste systems is that these systems penetrate the base during the coating process and significantly contaminate the production plant in the steps that follow. As a result, not only is the quality of the article considerably impaired, but the production plants have to be stopped far more frequently in order to laboriously clean machine parts.

Furthermore, the penetration means that the glue bottom dot cannot be formed effectively and, after the powder has been scattered (double dot coating), an inhomogeneous, somewhat convex dot is formed. Spreading the dot also causes the bottom dot to be "smeary", and therefore the powder in the edge regions of the bottom dot and also to some extent in the intermediate spaces cannot be sucked away effectively. In addition to contaminating the plant, this leads to attenuation of the composite following bonding.

SUMMARY

An aspect of the invention provides a thermally fusible fabric, configured for a fusible interlining in the textile industry, the fabric comprising: a substrate comprising a textile material to which a coating of polyurethane foam is applied, wherein the polyurethane foam comprises a thermoplastic polyurethane comprising, in reacted form, a bifunctional polyisocyanate (A) having an isocyanate content of from 5 to 65 wt. %, a polyol (B) comprising a polyester polyol, polyether polyol, polycaprolactone polyol, polycarbonate polyol, copolymer of polycaprolactone polyol, polytetrahydrofuran, or a mixture of two or more of any of these, and optionally, a chain extender (C), wherein the polyurethane foam has a pore structure in which more than 50% of the pores have a diameter, measured according to DIN ASTM E 1294, which is in a range of from 5 to 30 μm.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
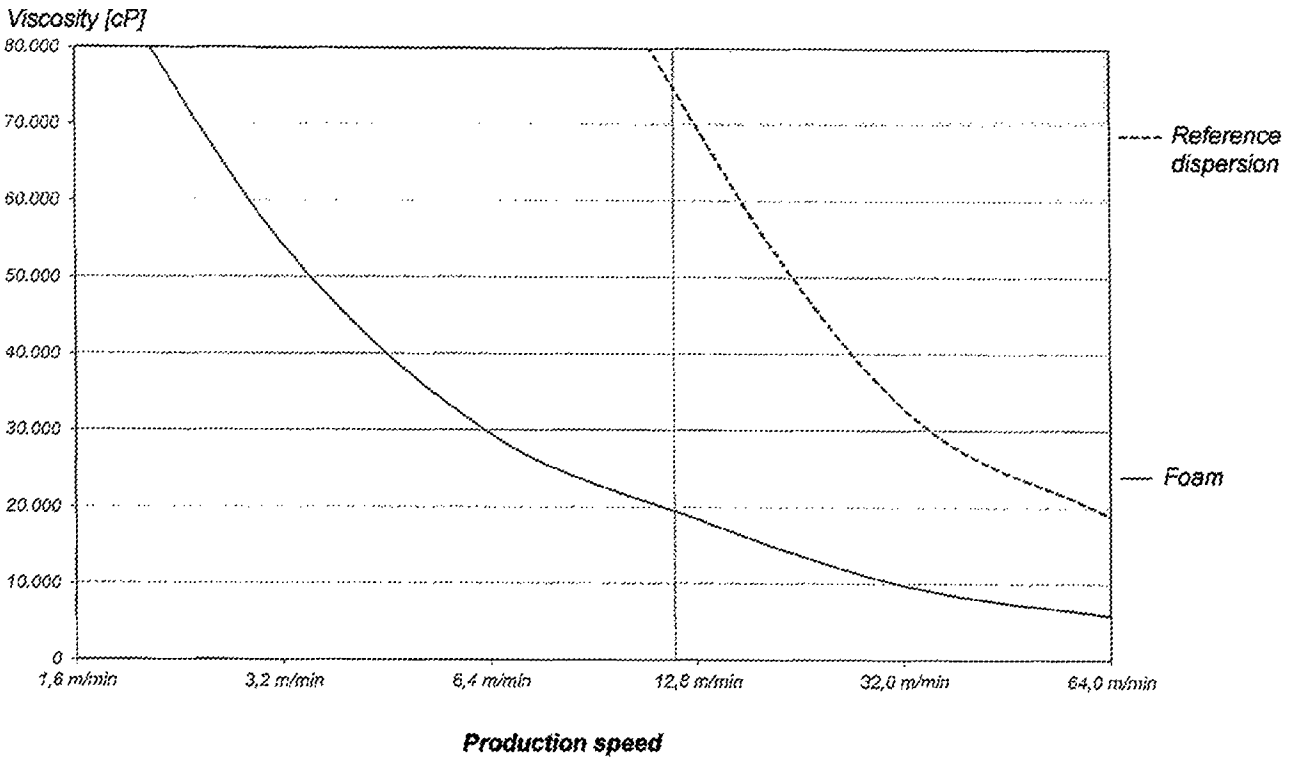
FIG. 1 the rheological behavior of the printing paste or the foam as a function of the coating speed.

An aspect of the present invention is to provide textile fabrics, which can also be fused to thin, transparent, flexible or very open cover materials.

Furthermore, the textile fabrics are intended, in aspects, to be easily processable using conventional fusing presses, are intended to display very good haptic and visual properties, to be simply and cost-effectively producible, to have very good wash resistance up to 95° C., and to also withstand drying conditions at high cycle numbers.

Another aspect of the invention is to make the textile fabrics highly resilient, in particular in the transverse direction.

An aspect of the invention provides a thermally fusible fabric that can be used in particular as a fusible interlining in the textile industry, comprising a substrate made of a textile material to which a polyurethane foam coating is applied, which foam contains a thermoplastic polyurethane in the form of a transformation product including

- at least one bifunctional, preferably aliphatic, cycloaliphatic or aromatic polyisocyanate (A) having an isocyanate content of from 5 to 65 wt. %,
- at least one polyol (B) selected from the group consisting of polyester polyol, polyether polyol, polycaprolactone polyol, polycarbonate polyol, copolymer of polycaprolactone polyol, polytetrahydrofuran and mixtures thereof, and optionally comprising
- at least one chain extender (C), the polyurethane foam having a pore structure in which more than 50% of the pores have a diameter, measured according to DIN ASTM E 1294, which is in the range of from 5 to 30 μm.

The foam coating in the fabric according to an aspect of the invention is characterized by a very homogeneous and narrow pore size distribution, and high stability. It is assumed that this is made possible by reducing the proportion of foaming agent in the foam coating. The invention has surprisingly shown that the use of a foaming agent, as is conventional in the art, does not improve the foam structure of the foam coating, but the pore size of the polyurethane foam is considerably increased and the polyurethane foam coating is very smeary.

It is advantageous for the proportion of foaming agents in the foam coating, based on its active, foaming constituents, to be less than 1.5 wt. %, more preferably less than 1 wt. %. Particularly preferably, said coating does not contain any foaming agents. According to the invention, "foaming agents" are understood to mean compositions containing surfactants and/or mixtures of surfactants, which have a foaming effect when producing the polyurethane foam. Conventional foaming agents are, for example, ®RUCOCOAT FO 4010 or ®TUBICOAT SCHÄUMER HP.

According to the invention, the polyurethane foam can be provided with a pore structure in which more than 30% of the pores have a diameter in the range of from 5 to 20 μm, preferably from 5 to 18 μm, and in particular from 10 to 16 μm, and/or in which more than 50% of the pores have a diameter in the range of from 5 to 25 μm and in particular from 10 to 20 μm, and/or in which more than 70% of the pores have a diameter in the range of from 5 to 30 μm, preferably from 5 to 27 μm, and in particular from 10 to 25 μm, and/or in which more than 97% of the pores have a diameter in the range of from 5 to 60 μm, preferably from 5 to 55 μm, and in particular from 10 to 50 μm.

Furthermore, the polyurethane foam can be provided with a pore structure, in which the average pore diameter is comparatively small, to be specific preferably in the range of from 5 to 30 μm, and preferably from 10 to 25 μm, and in particular from 10 to 20 μm. The average pore diameters can be determined according to the standard ASTM E 1294

(Coulter porometer). If the value of the average pore diameter is low or high, the foam tends to collapse.

For this reason, when such a polyurethane foam is applied, it scarcely penetrates the substrate due to its low density. This is advantageous in that very light non-woven fabrics or very light, open woven fabrics or knitted fabrics having good separation force values can also be coated at high speeds as a result, without soiling the coating equipment.

Due to its specific pore structure, the polyurethane foam is also breathable and allows moisture to pass through, having a positive effect on the wear comfort. The pore structure of the polyurethane foam is also very even, this being advantageous for uniform air circulation and uniform air permeability.

The average depth to which the polyurethane foam penetrates the substrate is preferably less than 20 μm, preferably less than 15 μm, and more preferably from 5 to 10 μm.

It has also been found that, when applying a polyurethane foam having the pore structure according to the invention, both the coating and the quality remain constant over a longer coating period. Furthermore, applying said polyurethane foam in the form of a pattern of dots is advantageous in that a homogeneous, raised bottom dot foam can be obtained, which, even when scattering hot-melt adhesive powder, does not collapse, and, after sintering and drying in the furnace, an effectively fused glue dot consisting of the foam bottom dot and thermoplastic glue is formed. During the entire process and during drying, the foam remains stable and does not collapse. In particular, the fine-pored foam structure can be maintained during the entire process.

Furthermore, the application of a polyurethane foam generally has a variety of advantages over conventional paste coating, which is usually applied by rotary screen printing or by means of a doctor blade.

The polyurethane foam is therefore considerably more cost efficient than pure paste printing, since the proportion of raw materials is much smaller when the coating is the same.

It is also advantageous that penetration through the interlining does not occur. In contrast, a pure binder print mixture penetrates the interlining or penetrates through the interlining to a greater extent. Production tests also show that, in foam printing, the back of the raw product that is printed on remains dry, whereas in paste printing this material is completely soaked.

For this reason, interlinings coated with foam have a softer texture than the interlinings provided with conventional glue.

In addition, in foam printing, no allowances need to be made with regard to the adhesion step both before and after the treatment steps and to the re-adhesion of the products produced, since these properties are on a comparable level to those when coating using pure paste.

Due to the porous structure of the polyurethane foam, it is possible to provide the fabric according to the invention with a high degree of air permeability. According to the invention, this is determined according to DIN EN ISO 9237. The standard atmosphere is specified according to DIN 50014/ISO 554, the test result is given in $dm^3/s*m^2$.

According to a preferred embodiment of the invention, the polyurethane foam has a degree of air permeability of more than 150 $l/m^2/s$ at 100 Pa, preferably of from 200 to 800 $l/m^2/s$, more preferably of from 400 to 1400. This allows for high wear comfort when used as an interlining.

In another preferred embodiment, the polyurethane foam can be smoothed by means of a calender. As a result, the breathability or the air permeability can be set in a targeted manner. The layer thickness can also be set at the calender by means of the foam application and by means of the parameters. The greater the smoothing effect, the more dense the layer is up to a migration resistance, for example with respect to feathers, down, etc.

Furthermore, the specific polyurethane foam makes it possible to provide the fabric according to the invention with good properties with regard to increased tear strength, stitch tear strength and/or needle tear strength and seam strength.

Furthermore, by using the polyurethane, a high degree of resilience of the fabric, in particular in the transverse direction, can be achieved. More rigid non-woven fabrics can therefore also be used, without experiencing any disadvantages in terms of the overall haptic performance. Furthermore, it is also possible to make the fabric more resilient by means of the polyurethane coating alone, without having to draw on fibers (e.g. BICO fibers) or yarns having high resilience. As a result, new products having specific properties can be produced, such as a resilient, bonded interlining based on a conventional polyamide/polyester non-woven fabric.

Another advantage of the use of polyurethanes is that the textile fabric according to the invention has a soft, resilient, nice (pleasant) texture. The texture of the interlining is a significant and important test in the textile industry. It is advantageous in particular for the pleasant texture to be achievable without additional finishes, such as silicone finishes for the base.

In addition, there is a great degree of synthesis freedom when using polyurethanes. Therefore, a large selection of monomers is available for polyurethane synthesis, making it easy to set the desired physical properties such as hardness, resilience, etc.

The layer thickness of the polyurethane foam can be set depending on the desired properties of the fabric. For most intended uses, it has proven advantageous for the average layer thickness of the polyurethane foam to be set in the range of from 5 to 400 μm, preferably from 5 to 100 μm, and in particular from 10 to 50 μm. The layer thickness can be determined electron-microscopically.

Accordingly, the weight per unit area of the polyurethane foam can vary depending on the desired properties of the fabric. It has proven expedient for most intended uses for the weight per unit area of the polyurethane foam to be set in the range of from 0.1 $g/m^2$ to 100 $g/m^2$ in the case of a planar coating. In dot coatings, weights per unit area of from 0.5 $g/m^2$ to 10 $g/m^2$ have proven expedient.

According to the invention, it is preferable to use aqueous, non-reactive or reactive, preferably non-reactive, polyurethane dispersions to produce the polyurethane foam.

The aqueous, non-reactive polyurethane dispersions generally have a polyurethane content of between 5 wt. % and 65 wt. %. According to the invention, polyurethane dispersions having a polyurethane content of between 30 wt. % and 60 wt. % are preferable.

The Brookfield viscosity of the aqueous, non-reactive polyurethane dispersions that are preferred according to the invention is preferably between 10 and 5000 mPa·s at 20° C., but particularly preferably between 10 and 2000 mPa·s.

According to the invention, aqueous, non-reactive polyurethane dispersions can be used to generate the polyurethane foam, the polyurethanes contained in said dispersions being produced from the components defined in claim 1:

Organic diisocyanates and/or polyisocyanates are preferably used as the polyisocyanate (A).

Polyols having a molecular weight of from 500 to 6000 g/mol are preferably used as the polyols (B). It is particularly preferable for said polyols not to contain any ionic groups or functional groups that can be converted into ionic groups.

Dihydroxy compounds or monohydroxy compounds having at least one ionic group or functional group that can be converted into an ionic group are preferably used as the chain extenders (C).

Compounds having one or two functional groups that react with isocyanate and at least one ionic group or functional group that can be converted into an ionic group can also optionally be used to produce the thermoplastic polyurethane.

Furthermore, compounds can be used that have at least two functional groups that react with isocyanate, have a molecular weight of from 60 to 500 g/mol, and do not contain any ionic groups or functional groups that can be converted into ionic groups.

The organic polyisocyanates (A) can be both aromatic and aliphatic. According to the invention, aqueous, non-reactive, aliphatic polyurethane dispersions are preferably used to produce the polyurethane foam, since the aliphatic polyurethane foams obtained are substantially more light-stable than aromatic polyurethane coatings.

The polyols (B) can be based on polyester polyols, polyether polyols, polycaprolactone polyols, polycarbonate polyols, copolymers of polycaprolactone polyol, polytetrahydrofuran and mixtures thereof. According to the invention, polyester polyols or polyether polyols and mixtures thereof are preferred.

Polyether polyols are to be preferred for uses that require a polyurethane foam having a low glass transition range and/or effective hydrolysis resistance. Polyester polyols are to be preferred for uses that require a polyurethane foam having good mechanical properties, such as abrasion.

Practical tests have shown that, when using pure polyester polyols, optionally in combination with polyether polyols, polyurethane foams can be obtained that have surprisingly high wash stability. Therefore, a polyurethane foam based on polyester polyol could be produced, which withstands several washes at 95° C. and also post-processing applications, without its properties deteriorating.

The melting temperature range of the polyurethane is preferably from 130 to 300° C., more preferably from 160 to 250° C., in particular from 180 to 220° C.

The glass transition temperature ($T_g$) value for the polyurethane is preferably from −100° C. to 100° C., more preferably from −80° C. to 30° C., in particular from −60° C. to 30° C.

In a preferred embodiment of the invention, polyurethanes preferably having high elongation values from 100 to 2500%, more preferably from 500 to 2000%, in particular from 700 to 1500%, are used. As a result, interlinings having resilient coating behavior and a particularly pleasant texture can be obtained.

In a preferred embodiment of the invention, polyurethanes and/or polyurethane compositions preferably having moduli of from 0.5 to 30 MPa, more preferably from 1 to 15 MPa, in particular from 1.5 to 5 MPa, are used.

In a preferred embodiment of the invention, polyurethanes and/or polyurethane compositions preferably having tensile strengths from 5 to 50 MPa, more preferably from 15 to 40 MPa, in particular from 20 to 30 MPa, are used.

In a preferred embodiment of the invention, polyurethanes and/or polyurethane compositions preferably having shore hardness from 30 to 120, more preferably from 40 to 90, in particular from 50 to 70, are used.

The polyurethane can be either chemically crosslinked or uncrosslinked. Therefore, the polyurethane foam can comprise at least one crosslinking agent, preferably selected from aziridines, isocyanates, blocked isocyanates, carbodiimides or melamine resins, for example. By modulating the polyurethane foam using crosslinking agents, the viscoelastic properties of the polyurethane foam can also be modulated in a targeted manner and the removal behavior can be set. Furthermore, the crosslinking agents can be used to vary in a targeted manner both the texture and the cleaning resistance. By using crosslinking agents, the performance of the separation force of the foam can thus be increased, in particular after washing or dry cleaning.

In a preferred embodiment of the invention, the polyurethane has a degree of crosslinking of less than 0.1, more preferably of less than 0.05, more preferably of less than 0.02. Most preferably, the polyurethane is completely uncrosslinked. The invention has surprisingly shown that even the foam structure of an uncrosslinked or only slightly crosslinked polyurethane has a high degree of wash stability, even at 95° C. Uncrosslinked or only slightly crosslinked polyurethane is advantageous in that it is very flexible and has a softer texture.

Practical tests have shown that it is particularly expedient for the polyurethane foam to contain dimethyl cellulose and/or, preferably and, polyacrylic acid as thickener. It has been found that the use these substances produces a particularly uniform, bubble-free coating.

Furthermore, it has been found that, in order to stabilize the polyurethane foam and in particular to set the pore size distribution according to the invention, it is advantageous for the polyurethane foam to contain foam stabilizers, in particular ammonium stearate or potassium oleate, preferably in an amount of from 1 to 10 wt. %.

As explained above, the invention has shown that it is disadvantageous for the polyurethane foam to contain foaming agents, in particular surfactants.

It has also proven disadvantageous for the polyurethane foam to contain associative thickeners, in particular hydrophobically modified polyacrylates, cellulose ethers, polyacrylamides, polyethers or associative polyurethane thickeners. In order to achieve the desired viscosity, in particular an excessively high quantity of the associative thickeners is required. As a result, mixing becomes swift/long and pulls threads. For this reason, it is advantageous for the polyurethane foam to comprise these compounds in an amount of less than 5 wt. %. More preferably, the polyurethane composition is free from these substances.

It has also proven disadvantageous for the polyurethane foam to contain thickeners containing mineral oil in combination with polyethylene glycol (PEG). If, for example, acrylate thickeners containing mineral oil are used in the foam formulation, they displace the PEG in particular, which is insoluble in mineral oils. The PEG then forms a very smeary residue on the polymer film. For this reason, provided it contains PEG as solvent aid, the polyurethane foam advantageously comprises thickeners containing mineral oil in an amount of less than 10 wt. %.

The polyurethane foam is particularly preferably free from these substances. This is also advantageous in respect of the emission values of the polyurethane foam applied. In addition, exhaust air pipes, dryer cooling zones, etc. are burdened to a lesser extent by condensate of the mineral oils, most of which have a low boiling point. This is also positive because the interlinings are contaminated by condensate to a lesser extent, thus increasing the quality thereof.

As mentioned above, the use of PEG in combination with thickeners containing mineral oil can be disadvantageous. However, in principle, the use of PEG is advantageous. It has proven to be particularly suitable for the proportion of PEG in the polyurethane foam to be in the range of from 1 to 40 wt. %.

In a preferred embodiment of the invention, the polyurethane foam contains a filler, in particular a filler selected from aluminosilicates, preferably kaolin, calcium silicates, calcium carbonates, magnesium carbonates, layered silicates, pyrogenic silicic acids and aluminum oxides such as wollastonite, dolomite, mica, barytes or talc. The amount of filler is preferably from 0.5 to 55 wt. %, more preferably from 5 to 45 wt. %, based on the overall weight of the polyurethane foam in each case. In this case, the filler preferably has an average particle size of from 5 nm to 100 μm. By modulating the polyurethane foam with fillers, the viscoelastic properties thereof (rheology), the texture, the cleaning resistance, the pore size distribution, the tackiness and the removal behavior can also be set in a targeted manner.

It can also be advantageous to use fillers that release gas during drying in the furnace, and therefore contribute to the formation of the foam and stabilize the foam.

In another advantageous embodiment of the invention, the polyurethane foam contains an additive selected from active coals, carbon black, phase change materials (PCMs), thermoplastic polymer powder, Expancel, flock, adhesion promoter, flame retardants such as magnesium hydroxides and/or aluminum hydroxides or phosphorous compounds, coating pigments such as titanium dioxide, superabsorbers such as polyacrylic acid, wood chips, zeolites, metal powders, magnetic particles such as iron oxide, encapsulate materials such as dyes, odorants or active ingredients (wound dressing), or odor-absorbing materials such as cyclodextrins or PVPs, preferably in an amount of from 0.1 to 70 wt. %, more preferably from 5 to 60 wt. %, based on the overall weight of the polyurethane foam in each case.

Furthermore, the fabric according to the invention comprises a substrate. It has proven expedient here to optimally set the polarity of the foam to the substrate. A hydrophobic base requires a hydrophobic foam whilst a hydrophilic base requires a hydrophilic foam.

The textile material to be used for the substrate is selected on the basis of the particular intended use or the particular quality requirements. Non-woven fabrics, woven fabrics, knitted fabrics or the like are suitable, for example. For example, waddings have proven to be particularly suitable since the use of waddings as a functional finish is widespread. The invention in principle does not set any limits whatsoever in this respect. A person skilled in the art can easily find the material combination suitable for his application. The substrate preferably consists of a non-woven fabric.

The non-woven fabric, including the threads or yarns of the textile materials, can consist of synthetic fibers or of natural fibers. Polyester fibers, polyamide fibers, regenerated cellulose fibers and/or binding fibers are preferably used as synthetic fibers, with wool fibers or cotton fibers preferably being used as natural fibers.

The synthetic fibers can in this case be crimpable, crimped and/or uncrimped staple fibers, crimpable, crimped and/or uncrimped, directly spun continuous fibers and/or finite fibers, such as meltblown fibers. The substrate can consist of one or more layers.

The technologies set out at the outset can be used to produce the non-woven fabric. In this case, the fibers of the fibrous web can be connected mechanically (conventional needling, water jet technology), by means of a binder or thermally to form a non-woven fabric. However, a moderate non-woven fabric strength of the substrate before printing is insufficient in this case, since, during printing, the mixture containing binder and thermoplastic polymer is applied to the substrate, then again more binder is applied, and said substrate is strengthened. For moderate non-woven fabric strengths, cost-effective textile raw materials can also be used, provided that they meet the requirements in respect of the texture. The process control can also be simplified.

When using staple fibers, it is advantageous to card these with at least one carding machine to form a fibrous web. In this case, random laying (random technology) is preferred, as are combinations of longitudinal laying and/or crosswise laying or more complicated card arrangements are possible if specific non-woven properties are intended to be made possible or if multilayer fibrous structures are desired.

Fibers having a fiber titer of up to 6.7 dtex are particularly suitable for interlinings. Rougher titers are not normally used due to their high fiber stiffness. Preferably, fiber titers in the range of from 1 to 3 dtex and microfibers having a titer of <1 dtex are conceivable.

According to a preferred embodiment of the invention, the polyurethane foam is planar. According to another preferred embodiment of the invention, the polyurethane foam is formed as a pattern of dots. In this case, the dots can be distributed over the substrate in a regular or irregular pattern.

A hot-melt adhesive can be applied to the polyurethane foam.

Hot-melt adhesives, also referred to as "hot melts", have been known for a long time. In general, these are understood to mean substantially solvent-free products, which, when molten, are applied to an adhesive surface, solidify quickly as they cool and therefore quickly increase strength. According to the invention, thermoplastic polymers such as polyamides (PA), copolyamides, polyesters (PES), copolyesters, ethylene-vinyl acetate (EVA) and the copolymers thereof (EVAC), polyethylene (PE), polypropylene (PP), amorphous polyalphaolefins (APAO), polyurethanes (PU), etc. are preferably used as the hot-melt adhesives.

The adhesive effect of the hot-melt adhesives is fundamentally based on the fact that they can reversibly fuse in the form of thermoplastic polymers and, as liquid melts, are able to wet the surface to be bonded and to thereby form a bond thereto due to their viscosity, which is reduced by the melting process. As a result of the subsequent cooling step, the hot-melt adhesive re-solidifies to its solid form, which is highly cohesive and thus produces the bond to the adhesive surface. Following adhesion, the viscoelastic polymers ensure that the bond is maintained, even after the cooling process and the changes in volume caused thereby, and the associated build-up of mechanical stresses. The bond formed transfers the bonding strength between the substrates.

The hot-melt adhesives are advantageously used in powder form. The size of the particles is oriented to the surface to be printed, for example to the desired size of a bonding dot. In a pattern of dots, the particle diameter can vary between >0 μm and 500 μm. In principle, the particle size of the hot-melt adhesive is not uniform, but follows a distribution, i.e. a particle size spectrum is always present. It is expedient for the particle size to match the desired application amount, dot size and dot distribution.

Hot-melt adhesives in powder form can be applied by means of scattering, which is expedient in particular for bonding porous substrates in order to produce textile composites that are on the whole breathable. Scattering is also advantageous in that it is a simple application method for large-scale applications. Since thermoactivated powders, for example made of polyamides, polyesters or polyurethanes, are already tacky at low temperatures, they are suitable for gently laminating heat-sensitive substrates, e.g. high-quality textiles. On account of good flow properties in the activated state, an effective bond is produced even at a low pressure and a short pressing time; however, there is still a small risk of said hot-melt adhesives penetrating the woven fabric.

It is also conceivable for the hot-melt adhesive to be applied to the side of the substrate that faces away from the polyurethane foam.

In the case of a planar polyurethane foam, the polyurethane foam in this embodiment constitutes the bottom layer of a double-layered glue structure, on which a hot-melt adhesive top layer is arranged. In this case, the hot-melt adhesive top layer can either be in the form of a pattern of dots or can be planar.

In a preferred embodiment of the invention, the double-layered glue structure is of the kind in which the polyurethane foam and the hot-melt adhesive are formed as double dots, the polyurethane foam being formed as the bottom dot pattern and the hot-melt adhesive being formed as the top dot pattern. In this case, the double dots can be distributed over the substrate in a regular or irregular pattern.

According to the invention, "double-layered glue structures" are intended to be understood to mean the above-described planar, double-layered glue structure and double dots. Accordingly, the term "bottom layer" is intended to include both planar bottom layers and bottom dots, and the term "top layer" is intended to include both planar top layers and top dots.

The double dot, which is based on a polyurethane foam as the bottom dot and a loose powder as the top dot, is preferably applied to the substrate as a pattern of dots. This thus increases the softness and the resilience of the material. The pattern of dots can be distributed either regularly or irregularly. However, printing is in no way limited to patterns of dots. The double dot can be applied in any geometries, e.g. also in the form of lines, strips, net-like or latticed structures, dots having a rectangular, diamond-shaped or oval geometry, or the like.

The double-layered glue structures are characterized by a small amount of non-draining adhesive return flow, since the polyurethane foam applied first acts as a barrier layer. If a thermoplastic polymer, preferably having a melting point of <190° C., is admixed to the polyurethane foam, this contributes to the bonding. The re-adhesion of the interlining is, however, thereby worsened.

The polyurethane in the polyurethane foam can be present both in pure form and in mixtures. It is therefore also conceivable for the polyurethane foam to contain other polymers in addition to the polyurethane. The thermoplastic polymers that are not polyurethane can include polyacrylates, silicones, (co)polyester-based polymers, (co)polyamide-based polymers, polyolefin-based polymers, ethylene-vinyl acetate-based polymers and/or combinations (mixtures and copolymerisates) of said polymers, for example. In this case, the proportion of polyurethane is preferably from 20 to 100 wt. %, more preferably from 30 to 90 wt. %, and in particular from 40 to 90 wt. %, based on the total amount of polyurethane coating. According to the invention, polyacrylates and silicones are particularly preferred in this case.

The polyurethane foam is preferably present in a coating weight of from 0.1 to 100 g/m$^2$.

The invention has found that, by suitably selecting the composition of the polyurethane foam, a fabric having particularly good transverse resilience can be obtained. Practical tests have shown that, in a double-layered glue structure, the composition of the bottom layer has a considerably greater impact on the transverse resilience of the fabric than the composition of the top layer.

Furthermore, the polyurethane foam can contain thermoplastic polymers, which have a melting point of <190° C. and thereby contribute to bonding during the fusing process. A bottom layer that contains thermoplastic polymers, preferably thermoplastic copolyamide, copolyester or polyurethane or mixtures thereof, supports the top layer during bonding, but also yields a higher re-adhesion value. By using polyurethanes in the bottom layer, a substantially better bonding of the top layer is achieved and can therefore both increase the separation force and reduce powder loss. An advantage over polyamides, for example, is largely improved anchoring to the top dot, higher resilience and flexibility. Furthermore, the bonding strength on coated cover materials is aided.

Another advantage of the use of thermoplastic polymers having a melting point of <190° C., for example selected from the group of copolyamides, copolyesters or polyurethanes, is that it is thereby possible to use the polyurethane foam without an additional hot-melt adhesive coating. A production step can thus be spared. A grain fraction of <500 μm has proven to be particularly advantageous.

As explained, the hot-melt adhesive can contain thermoplastic copolyamide, copolyester or polyolefins, which can be mixed with the common thermoplastics, for example. PU, PA, PES, PP, PE, ethylene-vinyl acetate, copolymers, etc. have proven to be particularly suitable. The polymers can also be extruded together with the additional thermoplastics (compound).

Furthermore, the polyurethane foam could contain binder, such as in particular acrylate dispersions or silicone dispersions.

In the field of interlinings, it is advantageous for the hot-melt adhesive to be produced as a granular material having good degree of grindability. It is expedient for both the top layer fraction (generally 80-200 μm) and for the bottom layer (0-80 μm) that the grindability is in these limits. The ground particles advantageously have as round a geometry as possible, in order to ensure error-free scattering or error-free incorporation and sintering.

According to the invention, the hot-melt adhesives can also be used with the other coating methods common in the field of interlinings, such as powder dot, paste printing, double dot, scattering or hot-melt methods, scattering coating, etc. For this purpose, other grain size distributions or a paste formulation, for example, are expediently used.

It is also conceivable for no clear phase boundary to be discernible between the top layer and the bottom layer. This can for example be caused by the fact that a thermoplastic polymer in particle form is mixed with a polyurethane dispersion, foamed and applied. Following application, the polyurethane is separated from the coarser particles, in which the coarser particles come to lie on the upper side of the bonding surface more, for example the dot surface. In addition to its function of anchoring in the substrate and also bonding said layer, the polyurethane bonds the coarser particles. At the same time, the particles are separated in part from the polyurethane on the surface of the substrate. The polyurethane penetrates the material to a greater extent, while the particles accumulate at the surface. As a result, although the coarser polymer particles are incorporated in the binder matrix, their free face (surface) at the surface of the non-woven fabric is available for directly bonding to the cover material. A double-dot-like structure is formed, in which, in contrast to the known double-dot method, only a single method step is required to generate this structure, and the complex process of suctioning off excess powder is also dispensed with. The interlinings are thereby more resilient and have a greater degree of recovery than those comprising conventional polyamide-based or polyester-based polymers.

A preferred method for producing a thermally fusible fabric according to the invention comprises the following measures:

a) providing a substrate, b) foaming a polyurethane dispersion that contains a thermoplastic polyurethane in the form of a transformation product consisting of at least one bifunctional polyisocyanate (A) having an isocyanate content of from 5 to 65 wt. % comprising at least one polyol (B) selected from the group consisting of polyester polyol, polyether polyol, polycaprolactone polyol, polycarbonate polyol, copolymer of polycaprolactone polyol, polytetrahydrofuran and mixtures thereof, and optionally comprising at least one chain extender (C), thereby forming a polyurethane foam such that the polyurethane foam has a pore structure in which more than 50% of the pores have a diameter, measured according to DIN ASTM E 1294, in the range of from 5 to 30 μm, c) applying the polyurethane foam to selected surface regions of the substrate, and d) heat-treating the substrate obtained in step c) in order to dry and simultaneously bond the polyurethane foam to the substrate, forming a coating.

The components of the polyurethane dispersion can be selected in the manner discussed above with reference to the polyurethane foam.

In order to ensure a raised print of a foam and to maintain the stability of the foam in the subsequent process, it is advantageous for the foam to have a specific minimum foam density (in g/L). For this purpose, it has proven expedient for the polyurethane foam used to form a planar coating to have a foam density of from 1 to 450 g/L, preferably from 50 to 400 g/L, in particular from 100 to 300 g/L. This can prevent the foam from excessively penetrating the interlining and effective anchoring in the interlining material can be achieved.

If the polyurethane form is to be applied in the form of a pattern of dots, polyurethane dispersions having a foam density of from 1 to 700 g/L, preferably from 200 to 600 g/L, in particular from 400 to 560 g/L, have proven to be particularly suitable.

The polyurethane dispersion can be foamed according to conventional methods, for example by mechanically whisking it.

It is also possible to foam the polyurethane dispersion by expanding microspheres. This foaming method can also be used in addition to mechanical foaming.

Microspheres are small, spherical plastics balls and consist of a thin thermoplastic shell, which encapsulates hydrocarbon, usually isobutene or isopentane. The shell is a copolymer that is formed by monomers such as vinylidene chloride, acrylonitrile or methyl methacrylate. By means of heating, the gas pressure inside the shell increases, which gradually softens at the same time. As a result, the volume of the microspheres increases. The foaming gas remains permanently enclosed. When the heat is removed, the shell solidifies in its enlarged form and forms a closed cell structure. In addition to the lower cost thereof, advantages of such a foam produced by means of microspheres also include better haptics, modified resilience and compressibility.

In order to produce the foam, the microspheres are homogenously distributed in the polyurethane dispersion. After applying the foam and optionally the hot-melt adhesive to the substrate, the microspheres expand, generally at temperatures in the range of from 80-230° C.

Practical tests have shown that the microsphere concentration is advantageously in the range of from 0.5-5 wt. %, based on the overall weight of the polyurethane dispersion.

It has also proven advantageous to use microspheres having a grain size of from 10 to 150 μm, more preferably from 10-16 μm, and/or an expansion temperature in the range of from 120-130° C.

According to a preferred embodiment, the polyurethane foam is produced by foaming an aqueous polyurethane dispersion.

The proportion of polyurethane in the dispersion is preferably in the range of from 25 to 95 wt. %, more preferably from 35 to 70 wt. %, in particular from 45 to 60 wt. %, based on the total weight of the dispersion. Interlinings coated with polyurethane foams produced from polyurethane dispersions of this type are characterized in that they have a much drier and more pleasant texture and are far more resilient.

The polyurethane dispersion can be produced by means of the emulsifier/shear force method, the melt dispersion method, the ketimine or ketazine method, the prepolymer/ionomer method and the universal acetone method and hybrids of said methods, for example.

The polyurethane dispersion can also be mixed with other aqueous dispersions, such as polyacrylate dispersions, silicone dispersions or polyvinyl acetate dispersions.

The polyurethane dispersion advantageously comprises crosslinking agents in an amount of less than 2 wt. %, more preferably of less than 1 wt. %, more preferably of less than 0.5 wt. %.

The solids content of the polyurethane dispersion can be between 10 and 70 wt. %, preferably between 15 and 60 wt. % and particularly preferably between 20 and 60 wt. %, in particular between 30 and 50 wt. %.

The polyurethane dispersion can be stabilized by internal and/or external anionic, cationic or neutral emulsifiers.

The pH of the polyurethane dispersion is preferably in the range of from 4.0 to 11.0, more preferably between 5.0 and 10.0, more preferably between 6 and 9.

As already mentioned above, it is advantageous for a polyurethane dispersion to be used that only contains a small amount of foaming agents, in particular surfactant-based foaming agents. It has thus proven expedient in respect of the pore size distribution for the proportion of foaming agents to be less than 5 wt. %. More preferably, the polyurethane dispersion is free of these substances.

In a preferred embodiment of the invention, a polyurethane dispersion is used that contains dimethyl cellulose and/or, preferably and, polyacrylic acid as the thickener, preferably in an amount of from 0.1 wt. % to 10 wt. %.

Furthermore, it has been found that, in order to stabilize the polyurethane foam and in particular to set the pore size distribution according to the invention, it is advantageous for the polyurethane dispersion to preferably contain the foam stabilizers, in particular ammonium stearate or potassium oleate for example, in an amount of from 1 to 10 wt. %.

In a preferred embodiment of the invention, a polyurethane dispersion is used that contains polyethylene glycol. It has proven to be particularly suitable here for the proportion of PEG in the polyurethane dispersion to be in the range of from 1 to 40 wt. %. It is advantageous here that the drying times of the polyurethane foam can be markedly reduced and the printability of the polyurethane foam or the rheological behavior thereof is significantly improved.

The polyurethane foam can be applied in various ways.

Therefore, in order to form a two-layered glue structure on a polyurethane foam applied in a planar manner as the bottom layer, a hot-melt adhesive can be applied by means of the double-dot method or the paste-dot method, for example. Alternatively, the hot-melt adhesive can also be applied to the bottom layer in the form of a loose powder.

The application of the paste dot as the top layer is advantageous since a substantially more textile texture is thereby produced than when a hot-melt adhesive is applied in a planar manner or when the double-dot method is used.

If, however, the side of the substrate that is not coated with polyurethane foam is coated with hot-melt adhesive, said side is preferably provided with a two-layered glue structure (double dot), in order to minimize re-adhesion.

The substrate made of a textile material or of a non-woven fabric can be directly covered with the polyurethane foam in a conventional doctor blade machine. In addition thereto, it may be sensible to wet the substrate with auxiliary textile agents such as thickeners (for example partially crosslinked polyacrylates and the salts thereof), dispersants, wetting agents, solvent aids or texture modifiers, or to treat it in any other way prior to the printing process so as to ensure production reliability of the printing process.

According to the invention, a wide variety of cover materials can be used. The fabric has proven particularly suitable for fusion to a thin, transparent or perforated cover material.

The use of a thermally fusible fabric according to the invention is, however, not limited to this application. Other applications are also conceivable, for example as a fusible textile fabric in home textiles such as upholstered furniture, strengthened seat structures, seat covers or as a fusible and malleable textile fabric for vehicle accessories, in shoe components or in the hygiene/medical sector.

The invention will be described in the following on the basis of several examples, without being restricted to the general principle.

Production of various substrates coated with polyurethane

A non-woven base (100% polyamide) having a weight per unit area of 12 g/m$^2$ is coated according to the known double-dot method with various polyurethane foams and, for comparison, with various non-foamed polyurethane pastes. Here, a bottom dot paste is produced in a known manner. In order to form the polyurethane foams, a polyurethane dispersion is converted into a polyurethane foam by means of a commercially available food processor. Here, an aliphatic polyester urethane is used. This generates viscoelastic properties of the bottom dot in combination with a pleasant texture and very good wash resistance. A loose powder made of polyamide and having a melting point of 113° C. and an MFI value of 71 (g/10 min) (determined at 160° C. under a load of 2.16 kg) is used as the top dot. A CP250 having a hole diameter of 0.17 mm is used as the printing screen grid.

The additives described in Table 1 are added to the polyurethane dispersion.

During the coating process, 1.5 g of polyurethane paste and 1.5 g of polyurethane foam is applied and covered with 3 g of loose powder. These interlinings are fused at a temperature of 130° C. for 12 seconds and at a pressure of 2.5 bar (press: Kannegiesser EXT 1000 CU). A polyester-cotton cover material is used as the material. Table 1 shows the formulations used:

1.1 Raw Material Configuration:

TABLE 1

| | Reference polyurethane dispersion | Polyurethane dispersion 1 |
|---|---|---|
| Water | 135.7 g | 165.50 g |
| Defoamer (33%) | 4 g | |
| Foaming agent (surfactant) (83%) | 5 g | |
| PEG | 9 g | 32.50 g |
| PU auxiliary dispersion (49%) | 340 g | 183.0 g |
| Ammonia | 1.4 g | 1.4 g |
| Thickener 1 (80%) polyacrylic acid | 4.9 g | 14.20 g |
| Thickener 2 (25%) polyacrylic acid | | 14.2 g |
| Thickener 3 (3%) methyl cellulose | | 25 g |
| Foam stabilizer (30%) | | 12.0 g |

1.2 Sequence of Approach for Foam Formulations:

- supply cold water
- add PEG
- add PU auxiliary dispersion
- add ammonia
- add thickeners 2 and 3, carefully homogenize using the blade mixer
- add foam stabilizer
- determine viscosity (Brookfield RV T, spindle 5, 20 rpm, factor=200)
- determine the pH (target value: 8.8 to 9.3)
- foam for approx. 120 seconds at maximum revolutions using the food processor (Kenwood KM 280)
- determine the pot weight, target value for the foam density 500 g/L±50 g/L
- determine the viscosity (Brookfield RV T, spindle 5, 20 rpm, factor=200)
- General rule: excessively long mixing times should be avoided, since a foam can already be formed during the time specified. This can adversely affect the functionality of the foam mixer.

1.3 Results

It has been found that, when producing the foam, the most suitable combination is a combination of a polyacrylate thickener and methyl cellulose, since the rheology of the polyurethane dispersion can be optimally set as a result and a dry foam having a uniform pore size is produced. It has further proven advantageous for the proportion of solvent aid (PEG) in the foam to be set to more than 1 wt. %. Furthermore, a foam stabilizer based on ammonium stearate has proven to be particularly suitable. In addition, the conventional foaming agents could be dispensed with, thus surprisingly meaning that a particularly homogeneous foam having small pore sizes could be produced. The addition of less additives also reduces interactions with the rest of the raw materials in the dispersion, therefore making the foam considerably more effective.

Table 2 shows the separation force values observed for the coated and fused non-woven fabrics

TABLE 2

| Separation force [N/5 cm] | Paste printing | Foam printing |
|---|---|---|
| PES/BW primary | 2.5 | 2.5 |
| After 3 x DC | 1.3 | 1.5 |
| After 3 x 40° C. | 1.8 | 1.9 |
| CV primary | 4.0 | 4.4 |
| After 3 x DC | 2.3 | 2.2 |
| After 3 x 40° C. | 1.1 | 1 |
| PES primary | 3.6 | 3.6 |
| After 3 x DC | 1.6 | 2 |
| After 3 x 40° C. | 2.5 | 2.7 |

TABLE 2-continued

| Separation force [N/5 cm] | Paste printing | Foam printing |
|---|---|---|
| Transparent cover material | 4.1 | 4.0 |
| 1 x 40° C. | 1.7 | 1.5 |

It can be seen that foam printing does not have any negative effects on the separation force.

FIG. 1 shows the rheological behavior of the reference polyurethane dispersion and the polyurethane foam 1 as a function of the shear rate. Using a Brookfield RV T/spindle 7, the viscosity is determined at subsequent measurement speeds. Using the screen/film perimeter (0.64 m) of the production screens, the measurement speed can be converted into the production speed of the printing machine, e.g. measurement speed 2.5 rpm×screen perimeter 0.64 m=printing machine (film) 1.6 m/min; Brookfield viscometer measurement speeds: 2.5; 5; 10; 20; 50 and 100 rpm.

Here, it becomes clear that in principle the foam 1 has a lower viscosity than the reference dispersion used when the shear rates remain the same. This is a considerable advantage, since in dispersions, the increased penetration through the fabric generally has to be compensated for by a large increase in the viscosity. This in turn leads to considerable problems when designing the pumps and when uniformly applying the dispersions.

Furthermore, the polyurethane foam (solid line) provides a very pleasant printed image since the dot can be depicted in a highly raised manner, and also does not penetrate through the carrier. The foam is also applied in a very consistent manner across the width and length of the carrier. Furthermore, the relationship between the penetration depth and the dot geometry is well balanced. Furthermore, it can also be seen that the viscosity decreases as the shear rate increases in a similar way to in the paste, but occurs at substantially lower viscosities.

2. Field Test a) Foam Dot Printing

In the large-scale field test, the polyurethane dispersion 1 produced is foamed using a rotor-stator-mixer from MST and is applied to a 12 g/m$^2$ non-woven product using rotary screen printing (polyurethane foam 1). It could be determined that, despite a lower viscosity, the foam mixture penetrates the substrate to be coated far less than the very highly viscous reference polyurethane dispersion. The penetration depth can be effectively regulated by the foam density here. The drier the foam (the lower the density), the less the polyurethane foam penetrates the interlining, but the worse the running behavior is with regard to screen covering and print behavior. In this field test, the optimum pot weight is 500 g/L.

b) Foam Surface Printing

In the large-scale field test, the polyurethane dispersion 2 produced is foamed using a Top-Mix Compact 60 HANSA Mixer and applied to the entire surface of a 24 g/m$^2$ non-woven product by means of a "knife over roll" application system (polyurethane foam 2), and is dried in the furnace. The gap is set at 0.5 mm. The processor speed is 6 m/min at a pot weight of 125 g/L. The final overall application of the line of foam is 17.9 g/m$^2$. This test also clearly shows that the coating only penetrates the substrate to a minimum extent and a uniform coating can be generated over the entire surface (see FIG. 3). The foam coating is also stable when washed at temperatures of up to 95° C. and withstands dry cleaning without damage. The quality of the foam coating such as haptics and texture also remains unchanged.

| | Polyurethane dispersion 2 |
|---|---|
| Water | 184.3 g |
| PEG | 36.5 g |
| PU auxiliary dispersion (49%) | 154 g |
| Ammonia | 1.8 g |
| Thickener 2 (25%) polyacrylic acid | 17.5 g |
| Thickener 3 (3%) methyl cellulose | 28 g |
| Filler | 13.50 g |
| Foam stabilizer 2 (30%) | 15.0 g |

c) Coating the Foam Surface Coating with Paste Dot

The non-woven fabric produced in point 2b) comprising a line of foam is coated by means of the known paste dot method. Here, a standard glue system having a thermoplastic polyamide-based polymer is used, which has a melting point of 126° C. and an MFI value of 28 (g/10 min) (determined at 160° C. under a load of 2.16 kg). The aqueous paste also contains the standard auxiliary agents, such as emulsifiers, thickeners and process auxiliary agents. During the coating process, 12.5 g/m$^2$ paste is applied by knife-coating with a cP grid of 110. The fabric is then fused at a temperature of 120° C. for 12 seconds and at a pressure of 2.5 bar (Press: Multistar DX 1000 CU). A polyester-cotton cover material is used as the material. The primary separation force, the separation force after a 60° C. wash and a 95° C. wash and the separation force after dry cleaning are shown in the following table. Furthermore, the re-adhesion values are compared.

Table 3 shows the separation force values for the coated foam and the directly coated interlining

TABLE 3

| | Paste-coated foam surface coating | Directly coated non-woven fabric |
|---|---|---|
| Primary bonding [N/5 cm] | 5.8 | 8.2 |
| 1 x 60° C. wash [N/5 cm] | 5.1 | 5.3 |
| 1 x 95° C. wash [N/5 cm] | 6.8 | 5 |
| 1 x dry cleaning [N/5 cm] | 4.9 | 8.0 |
| Re-adhesion [N/10 cm] | 0.1 | 2.3 |

Surprisingly, it can be shown that, after cleaning, in particular at high temperatures, the separation force of the specimens comprising the polyester-polyurethane coating has higher values than the specimens that do not comprise an additional layer. Furthermore, re-adhesion is significantly reduced by the additional polyurethane foam layer.

d) Foam Coating with Polymer Particles 13 wt. % thermoplastic polyamide powder having a grain size distribution of 80-200 my is added to the polyurethane dispersion 2, which powder has a melting point of 108° C. and an MFI value of 97 (g/10 min) (determined at 160° C. under a load of 2.16 kg), and the polyurethane dispersion 1 is foamed in a similar way to that in point 1. The foam is then doctored on a 24 g/m$^2$ non-woven fabric base and dried in the furnace. The loading weight is 21.2 g/m$^2$.

The interlinings are then fused at a temperature of 130° C. or 140° C. for 12 seconds and at a pressure of 2.5 bar (press: Kannegiesser EXT 1000 CU). A polyester-cotton top layer is used as the material. The separation force results that are achieved when the non-woven article is coated with a standard polyamide paste at a coating of 20 g/m$^2$ and a cP of 110 are compared with one another.

TABLE 4

| | Polymer in foam | Polymer in paste |
|---|---|---|
| Primary bonding 130° C. [N/5 cm] | 10.0 | 8.3 |
| Primary bonding 140° C. [N/5 cm] | 12.3 | 10.1 |

3. Microscopic Images

Figure 2:
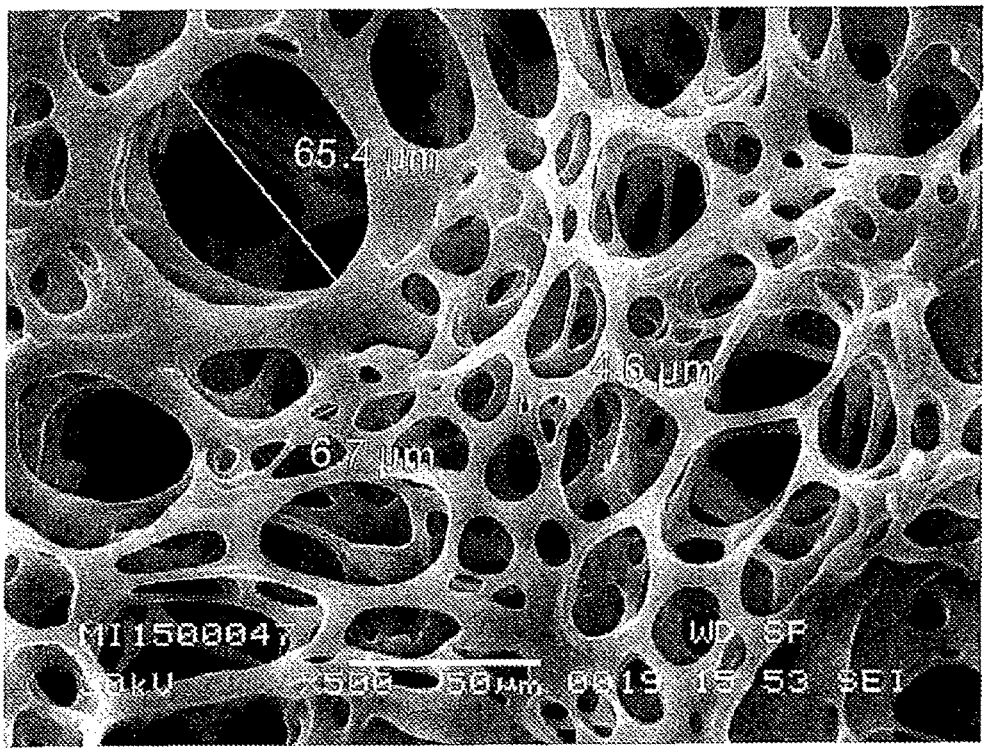
FIG. 2 an SEM image of a plan view of the polyurethane foam 2.

In FIG. 2, the SEM image of a plan view of the polyurethane foam 2 on the coated substrate is shown. A clear pore structure having a homogeneous pore size distribution in the range of from 10 to 40 μm can be seen.

Figure 3:
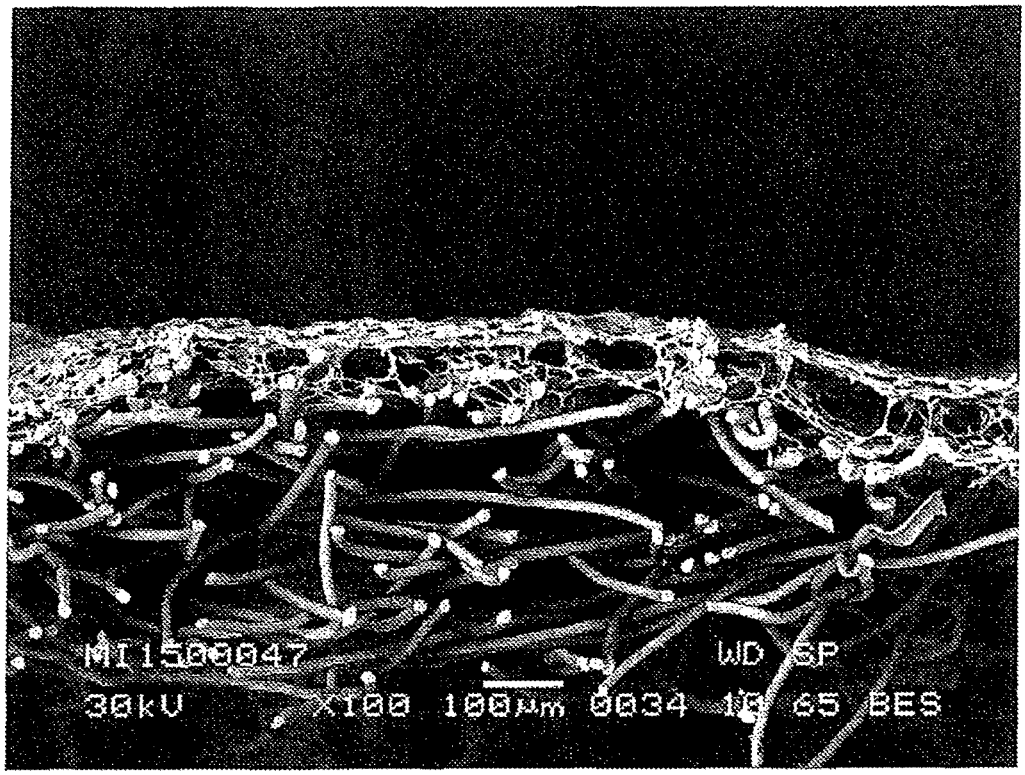
FIG. 3 an SEM image of a cross section of the polyurethane foam 2.

In FIG. 3, an SEM image of a cross section of the substrate covered with polyurethane foam 2 is shown. The very shallow depth to which the foam penetrates the substrate can be clearly seen.

4. Determination of the Pore Size Distribution of a Foam Coating According to the Invention (Polyurethane Dispersion 2)

The pore size distribution of the foam coating of a fabric according to the invention is measured in accordance with ASTM E 1294 (1989).

Test data
Test apparatus: PMI.01.01
Test specimen number: 3
Specimen size: diameter 21 mm
Specimen thickness: 1 mm
Test liquid: Galden HT230
Reaction time: >1 min
Test temperature: 22° C.

Figure 4:
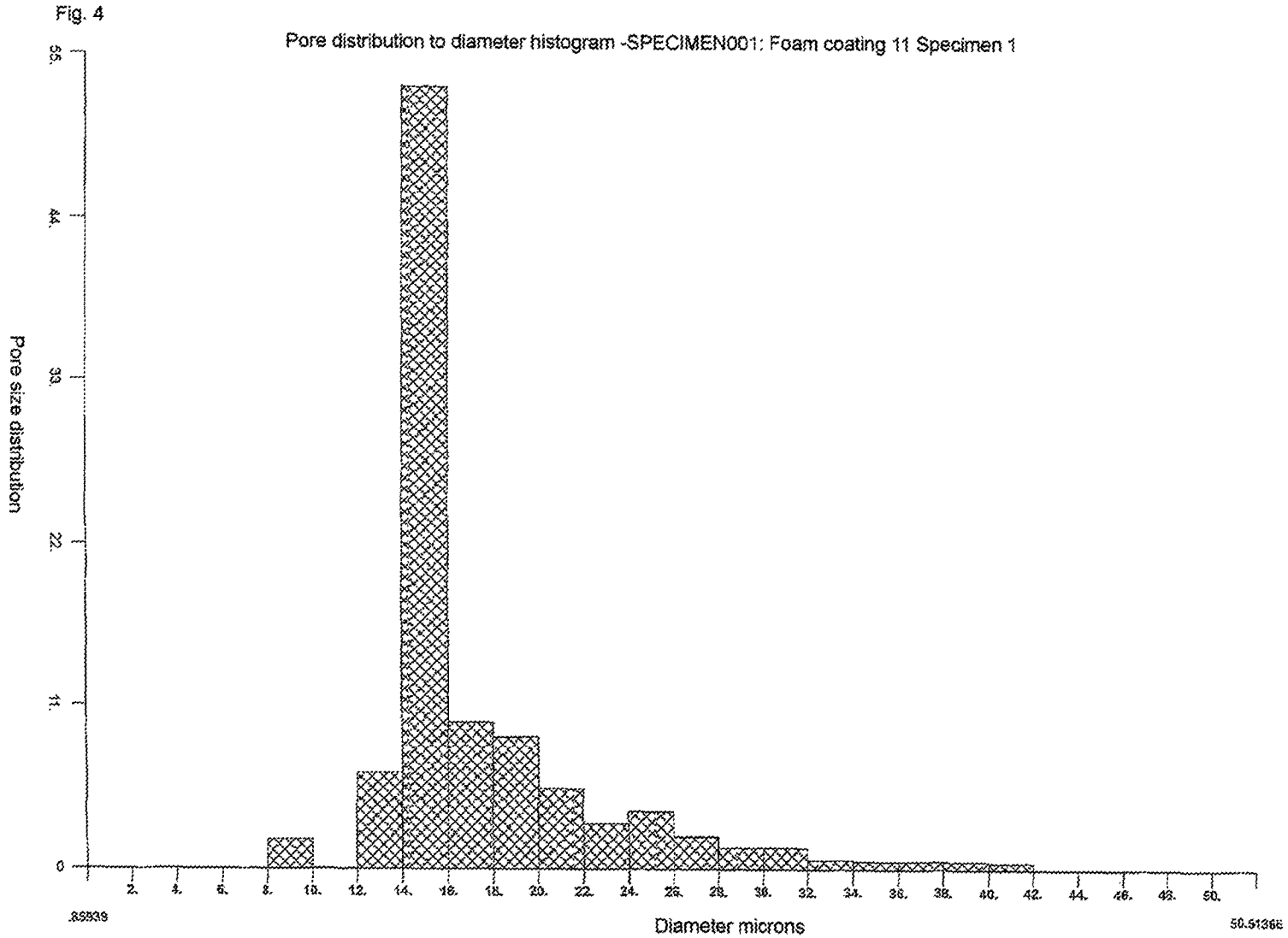
FIG. 4 the pore size distribution of the foam coating not comprising any foaming agent.

It has been found that the smallest pore diameter is 12.9 μm, the average pore diameter is 15.2 μm and the largest pore diameter is 50.5 μm. The pore size distribution is shown in FIG. 4.

5. Determination of the Pore Size Distribution of a Foam Coating According to the Prior Art (Polyurethane Dispersion 2 Comprising 2% Surfactant as the Foaming Agent)

The pore size distribution of the foam coating of a fabric is measured in accordance with ASTM E 1294 (1989).

Figure 5:
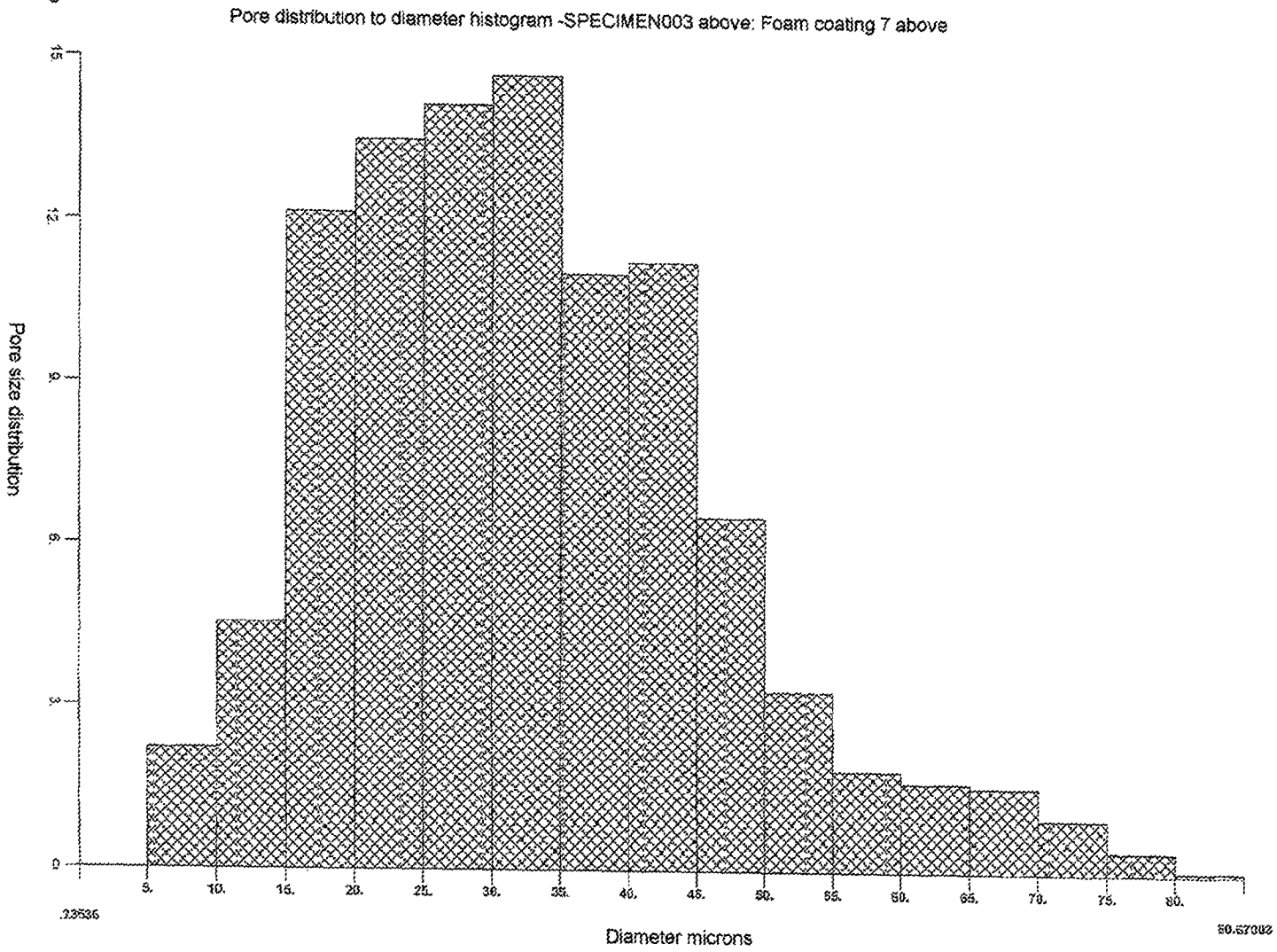
FIG. 5 the pore size distribution of the foam coating comprising 2 wt. % foaming agent.

It has been found that the smallest pore diameter is 8.9 μm, the average pore diameter is 31.1 μm and the largest pore diameter is 80.7 μm. The pore size distribution is shown in FIG. 5.

6. Determination of the Air Permeability of a Non-Woven Carrier Coated with Polyurethane Foam Compared with the Line of Paste Table 5 shows the air permeability according to DIN EN ISO 139 at 100 Pa

TABLE 5

| Non-woven material | 100% PES | 100% PES |
|---|---|---|
| Weight | 24 g/m$^2$ | 24 g/m$^2$ |
| Coating | 15 g/m$^2$ | 15 g/m$^2$ |
| **Tests** | **Foam** | **Pure line of paste** |
| Air permeability in [l/m$^2$/s] | 725 | 129 |
| | 649 | 131 |
| | 615 | 122 |
| Average | 663.0 | 127.3 |

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A thermally fusible fabric, configured for a fusible interlining in the textile industry, the fabric comprising:
- a substrate comprising a textile material to which a coating of polyurethane foam is applied,
- wherein the polyurethane foam comprises a thermoplastic polyurethane comprising, in reacted form,
- a bifunctional polyisocyanate (A) having an isocyanate content of from 5 to 65 wt. %,
- a polyol (B) comprising a polyester polyol, polyether polyol, polycaprolactone polyol, polycarbonate polyol, copolymer of polycaprolactone polyol, polytetrahydrofuran, or a mixture of two or more of any of these, and
- a chain extender (C),
- wherein the polyurethane foam has a pore size distribution in which more than 50% of the pores have a diameter of from 5 to 30 μm, as measured according to DIN ASTM E 1294.

2. The fabric of claim 1, wherein the polyurethane foam has an average pore diameter in the range of from 5 to 30 μm.

3. The fabric of claim 1, comprising a proportion of foaming agent in the polyurethane foam of less than 1.5 wt. %, based on active, foaming constituents thereof.

4. The fabric of claim 1, wherein an average depth to which the polyurethane foam penetrates the substrate is less than 20 μm.

5. The fabric of claim 1, wherein the polyurethane foam has a degree of air permeability of more than 150 L/m$^2$/s at 100 Pa, measured according to DIN EN ISO 9237.

6. The fabric of claim 1, wherein the polyurethane foam has an average layer thickness of from 5 to 400 μm.

7. The fabric of claim 1, wherein the polyol (B) comprises polyester polyol and/or polyether polyol.

8. The fabric of claim 1, wherein the polyurethane has a degree of crosslinking of less than 0.1.

9. The fabric of claim 1, wherein the polyurethane foam is either planar or present as a pattern of dots.

10. The fabric of claim 1, further comprising:
- a hot-melt adhesive, applied to the polyurethane foam and/or a side of the substrate facing away from the polyurethane foam.

11. The fabric of claim 10, wherein the polyurethane foam and the hot-melt adhesive are formed as double dots, the polyurethane foam being designed as a pattern of bottom dots and the hot-melt adhesive being designed as a pattern of top dots.

12. The fabric of claim 1, wherein the polyurethane foam is formed as a bottom layer of a double-layer glue structure, on which a hot-melt adhesive top layer is arranged.

13. The fabric of claim 1, wherein the thermoplastic polyurethane consists essentially of, in reacted form, at least one of the bifunctional polyisocyanate (A) having an isocyanate content of from 5 to 65 wt. %, at least one of the polyol (B) selected from the group consisting of polyester polyol, polyether polyol, polycaprolactone polyol, polycarbonate polyol, copolymer of polycaprolactone polyol, polytetrahydrofuran and mixtures thereof, and at least one of the chain extender (C).

14. The fabric of claim 1, wherein the polyisocyanate (A) is aliphatic.

15. The fabric of claim 1, wherein the polyisocyanate (A) is cycloaliphatic.

16. The fabric of claim 1, wherein the polyisocyanate (A) is aromatic.

17. The fabric of claim 1, wherein the polyurethane foam further comprises a foam stabilizer.

18. The fabric of claim 17, wherein the foam stabilizer is present in an amount from 1 to 10 wt. % of the polyurethane foam.

19. The fabric of claim 1, wherein the polyurethane foam is substantially free of a foaming agent.

20. A method for producing a thermally fusible fabric, the method comprising:

a) providing a substrate, b) foaming a polyurethane dispersion comprising a thermoplastic polyurethane comprising, as a transformation product, a bifunctional polyisocyanate (A) having an isocyanate content of from 5 to 65 wt. %;

a polyol (B) comprising a polyester polyol, polyether polyol, polycaprolactone polyol, polycarbonate polyol, copolymer of polycaprolactone polyol, polytetrahydrofuran, or a mixture of two or more of any of these; and a chain extender (C), thereby forming a polyurethane foam having a pore size distribution in which more than 50% of the pores have a diameter of from 5 to 30 μm, as measured according to DIN ASTM E 1294;

c) applying the polyurethane foam to one or more surface regions of the substrate, thereby obtaining a treated substrate; and d) heat-treating the treated substrate to dry and simultaneously bond the polyurethane foam to the substrate, forming a coating.

21. The method of claim 20, wherein the polyurethane foam forms a planar coating having a foam density of from 1 to 450 g/L and/or a pattern of dots having a foam density of from 1 to 700 g/L.

22. The method of claim 20, wherein a dispersion for the thermoplastic polyurethane comprises a crosslinking agent in an amount of less than 2 wt. %.

* * * * *